United States Patent [19]

Cameron et al.

[11] 3,933,406

[45] Jan. 20, 1976

[54] ELECTRICAL CONNECTOR BLOCK ASSEMBLY HAVING OVERCENTER LOCKING

[75] Inventors: John M. Cameron, Tempe, Ariz.; Robert D. Kennedy, Northville, Mich.

[73] Assignee: Ford Motor Company, Dearborn, Mich.

[22] Filed: Jan. 4, 1974

[21] Appl. No.: 430,971

[52] U.S. Cl. ..... 339/91 R; 285/DIG. 22

[51] Int. Cl.[2] ..... H01R 13/54

[58] Field of Search ..... 339/91 R, 255 P, 260, 261; 285/DIG. 22, 317, 319, 320; 292/19, 20, 31, 87

[56] References Cited

UNITED STATES PATENTS

| | | | |
|---|---|---|---|
| 1,448,100 | 3/1923 | Wigle | 292/31 |
| 1,665,303 | 4/1928 | Hunter | 292/31 |
| 3,368,182 | 2/1968 | Culver | 339/91 R |
| 3,523,269 | 8/1970 | Witek, Jr. et al. | 339/91 R |

*Primary Examiner*—Roy Lake
*Assistant Examiner*—Neil Abrams
*Attorney, Agent, or Firm*—Robert A. Benziger; Keith L. Zerschling

[57] ABSTRACT

The present invention provides electrical connector assembly block apparatus comprising a pair of matable connector block parts which are provided with mutually engagable overcenter locking or latching means. The over-center locking means are comprised of at least one pair of lever arm members located on one connector block part which are pivotal about and deflectable along two orthogonal axes and are engageable with a double ramp portion on the matable connector block part to provide overcenter locking. The lever arm members are provided with means for forcibly rotating the lever arm members about the one of the two orthogonal axes which is perpendicular to the connector block to separate the end portions thereby permitting easy disengagement of the end portions with the double ramp member. The rear surface of the ramp member is provided with a shaped notch which is matable with corresponding projections of the lever arm members to provide a locked position. The rear portion of the double ramp member is further provided with means forming a pair of divergent camming surfaces to separate the locking ends of the lever arm members.

6 Claims, 5 Drawing Figures

ELECTRICAL CONNECTOR BLOCK ASSEMBLY HAVING OVERCENTER LOCKING

BACKGROUND OF THE INVENTION

1. Field of the Invention

The present invention is directed to the field of matable electrical connector assembly blocks for establishing electrical circuits between pairs of conductors. More specifically, the present invention is directed to that portion of the above noted field which is concerned with the mechanism by which matable connector block members are maintained in assembled relationship. More particularly still, the present invention is directed to that portion of the above noted field which is concerned with mechanisms by which matable pairs of connector block members held in assembled relation by latching means of the overcenter locking type may be easily intentionally separated while maintaining a positively locked relationship when separation is not intended.

2. Description of the Prior Art

Matable electrical connector blocks which house pairs of mutually engagable electrical connector contacts and which are operative to maintain the contacts or terminals in an engaged relation are well known. Since the electrical contacts are usually recessed within the various portions of the electrical connector body it is known to be necessary to tightly engage the connector bodies to be sure that the electrical contacts are in an operable mutually engaged and conducting relationship. This connection may be assured in a variety of ways such as by providing mutually engagable screw and nut mechanisms on the sides of the connectors or by providing threaded connections between the pairs of matable connectors. Another form of assuring that the matable connector blocks are suitably engaged to provide for positive connection between the electrical contacts is to provide overcenter locking or latching apparatus. FIG. 1 of the drawing of this application illustrates one well known form of overcenter locking mechanism.

Connector blocks such as illustrated in FIG. 1 are frequently provided with a plurality of pairs of mutually interengagable electrical contacts which are intended to carry significant amounts of current which may reach values of several amperes or higher. These high values of current are frequently carried by bayonet type male contacts which are received between a pair of resiliently biased female contacts in the operative mode. In order to assure adequate contact between the pairs of contacts carrying high values of current it is normally the practice to provide a relatively high spring force between the contacts. This dictates that the overcenter locking mechanism provided with the connector blocks be arranged so that when the overcenter condition is reached a sufficiently high connecting force is generated to overcome any expected level of friction generated resistive force produced by the high level of spring force acting between the various pairs of electrical contact members.

In order to overcome the above noted high levels of resistive forces generated between the electrical contact members, overcenter locking mechanisms such as illustrated in FIG. 1 are normally comprised of at least one double ramp member situated on a first connector block member and at least one lever arm latching member situated on the mating connector block member. The latching member is engagable with the double ramp member when the connector is assembled. The double ramp member is normally provided with a first relatively gradual ramp surface which the lever arm latching member will initially engage when the matable connector block members are assembled and a second relatively steep rear ramp surface which provides an abrupt drop off. The connector block members are normally made of a relatively rigid plastic material having a high dielectric constant with the lever arm latching member capable of generating a relatively high degree of force when deflected through a small angle. The force is generated primarily by deformation of the latching member. Thus, the shallow or gradual ramp surface is operative to spread the lever arm member away from its normal position under the application of a relatively small degree of assembly force operating over an extended distance and the rear ramp surface is operative to rapidly accelerate the matable connector block members together once the overcenter position has been passed by dissipating the stored force over a relatively shorter distance. This mechanism is also operative to provide for complete separation of the two connector block members in the event that the overcenter position is not reached so that the connectors are forcibly separated and the lack of electrical circuit can be visually detected by the absence of mating of the two matable connector block members.

The structure briefly described hereinabove results in the anomalous situation that the connector block members may not be easily separated in order to accomplish any necessary servicing which may be required of the electrical apparatus assiciated with the circuits passing through the connector block members. This problem is further made more difficult by the fact that these connectors are frequently used to pass electrical current through wall structures under circumstances which make the connector relatively inaccessible once it has been installed in use. In those instances where more than one overcenter locking mechanism is provided on any one pair of matable connector block members it is normally the case that special tools are required to separate the connector block members with force levels being generated which approach levels sufficiently high to fracture the plastic. It is therefore a specific object of the present invention to provide an improved overcenter locking apparatus for pairs of matable connector block members which will operate in the same manner and with the same degree of reliability as prior overcenter locking mechanisms but which will be readily disengageable to permit easy intentional separation of the connector block members.

One way of accomplishing the general objectives set forth hereinabove would be to provide a rearwardly extending lever arm mechanism which could be gripped to forcibly move the double ramp member engaging end of the latching member outwardly away from the connector block member having the double ramp portion to facilitate the disassembly of the connector block members. As a practical matter however this is not possible due to the fact that the material forming the rearwardly extending portion would be deformable to the same degree that the forwardly extending latching member is deformable. Thus, even with a very long rearward extension, the lifting force necessary to overcome the resistance to deflection of the latching member and any binding with the double ramp portion could not be generated. It is therefore a further object of the present invention to provide a mechanism by which matable connector block members may be easily separated, which mechanism does not significantly increase the physical size of the connector block members and the space required within any associated housing structure to receive the connector block members. It is a further object of the present invention to provide an overcenter latching mechanism having improved release operation which may be integrally molded with the dielectric material normally utilized to form the matable connector block members.

SUMMARY OF THE PRESENT INVENTION

The present invention provides an overcenter locking or latching mechanism for matable connector block assembly members having a specially contoured double ramp portion formed on one of the matable pair and a locking mechanism formed on the other of the matable pair of connector blocks which locking mechanism is comprised of two distinct but cooperating lever arm members. The pair of lever arm members are pivotally connected to the connector block member through a connection which permits incremental rotational motion of each of the lever arm members about two orthogonal axes. Each lever arm member has a portion which extends from the pivotal connection in a direction which will permit it to come into contact with the double ramp member and a second portion which extends generally away from the first portion. The first portion is further provided with an end member adapted to contactively abut the double ramp portion and is further provided with a surface projection contoured to mate with a mating contour on the rear of the double ramp member to provide positive locking. Each lever arm forwardly extending portion is elastically deflectable along the two orthogonal axes to permit movement of a transversely extending end portion of the lever arm member for engagement with and disengagement from the double ramp member.

The double ramp member is provided with a pair of camming surfaces along the side wall portions thereof and is further provided with a suitably shaped, for example a V-shaped, notch or groove at the rear of the double ramp portion for receipt of suitably contoured projections on the lever arm members. The camming surfaces are arranged in proximity to the shaped groove.

DETAILED DESCRIPTION OF THE PREFERRED EMBODIMENT

Figure 1:
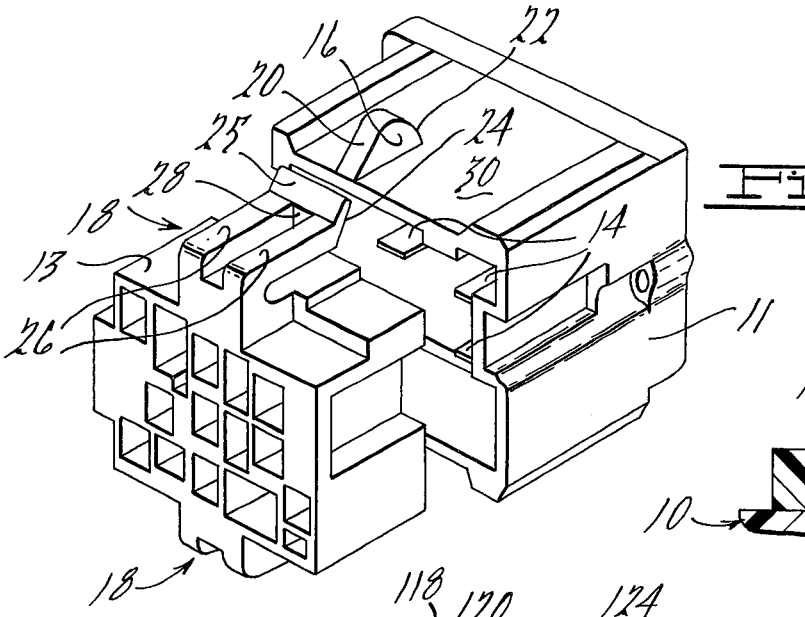
FIG. 1. PRIOR ART
FIG. 1 of the drawing illustrates a connector block assembly having an overcenter locking or latching mechanism according to the prior art.

Referring now to the drawings wherein like numbers designate like structure throughout the various views thereof, FIG. 1 illustrates an electrical connector block assembly having an overcenter locking mechanism according to the prior art. The connector block assembly is comprised of a first, in this case female, connector block member 11 and a second, in this case male, connector block member 13. The female connector block member 11 is provided with a plurality of bayonet type, male, electrical contact blades or members denoted as 14. The male connector block member 13 is provided with suitable female contact type members positioned to be complementary to the bayonet contact blades 14 for receiving these blades to establish electrical circuit communication therebetween. The female and male connector block members 11 and 13 are provided with an overcenter locking mechanism which is illustrated as comprising a double ramp member 16 situated on the first connector block member 11 and a corresponding locking or latching mechanism 18 mounted on the second connector block member 13.

Double ramp member 16 is provided with a first or forward ramp surface 20 and a second or rearward ramp surface 22. First ramp surface 20 is arranged to contactively abut a complementary surface 24 situated on the leading edge of the transverse element 25 of the locking or latching mechanism 18. Transverse element 25 is connected to the connector block member 13 by deflectable arm members 26. The ramp surface 20 and the complementary contactive surface 24 are suitably contoured so that motion of the male connector block member 13 toward and into connective relationship with the female connector block member 11 will produce a sufficient thrust on the surface 24 to cause the lever arm members 26 of the latching mechanism 18 to be deflected upwardly allowing the contactive surface 24 to ride up and over the double ramp member 16. Locking mechanism 18 is provided with a further abutment surface 28 which is arranged to fall behind, and be in locked engagement with, the the rearward ramp surface 22 of the double ramp member 16. Ramp surface 22 of this form of prior art connector is arranged to have a gradually increasing ramp angle so that at the point where the ramp surface 22 joins the upper surface 30 of the female connector block 11 it is virtually perpendicular to that surface. Other configurations are also well known. It will be appreciated that the specific slopes selected for the forward and rearward ramp surfaces 20, 22 will depend upon the force levels desired for assembly of the connector block members 11, 13 and the rigidity of the latching mechanism 18.

The engaging surface 28 provided on the latching mechanism 18 is here illustrated as being arranged to be also generally perpendicular to the upper surface 30 of the female connector block member 11. This provides a positive lock engagement between the male connector block member 13 and the female connector block member 11. The ramp surface 20 of the double ramp member 16 operating against surface 24 which will also act to forcibly separate the male and female connector block members by propelling them apart when the assembly force has been insufficient to cause the locking mechanism 18 to reach the overcenter position. However, once the overcenter position has been obtained, the ramp surface 22 on double ramp member 16 and the surface 28 are mutually cooperative to rapidly and forcefully propel the male member into fully assembled relation with the female member thereby providing that on visual inspection only an inspector may determine whether or not the electrical circuits have been properly completed.

It will be appreciated from a consideration of the foregoing and the illustration of FIG. 1 that the overcenter latching mechanism here illustrated and described presents a problem in the event of intentional disassembly. The amount of force required to separate the latching mechanism 18, particularly where a plurality of latching mechanisms are utilized, requires that a fairly high degree of force be applied without mechanical advantage such as that provided by the initial or forward ramp surface 20. Furthermore, the separation force required to remove the male connector member from the female connector member is relatively high due to the frictional forces exerted between the male and female electrical terminal or contact members with the added complication of maintaining the overcenter latching mechanism disengaged while separation is accomplished. It will thus be appreciated that the present invention, as it provides a mechanism for conveniently and easily unlocking the locking mechanism, is of great utility.

Figure 2:
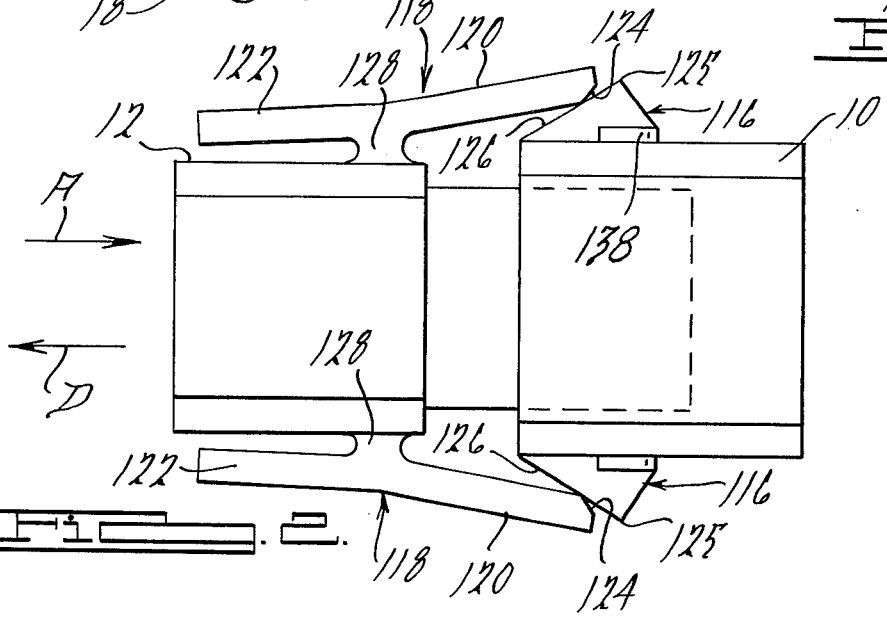
FIG. 2 illustrates in a side elevational view the overcenter locking mechanism of the present invention in a partially assembled configuration.

Referring now to FIG. 2, a pair of easily releasable overcenter locking mechanisms according to the present invention are illustrated in association with a first or female connector block member 10 and a matable second or male connector block member 12. In view of the fact that the overcenter locking mechanism of the present invention may be used with a wide variety of connector block configurations, and particularly with a wide variety of electrical terminal members, the connector blocks as here illustrated are intended to be merely representative and for that reason the configuration of the blocks is left in a simple rectangular block form without illustrating any representative configuration of the electrical terminals contained therein. Second connector block member 12 has been illustrated to be partially inserted within first connector block 10 resulting in contactive abutment between the double ramp members 116 and the latching mechanism 118, both according to the present invention. This contact has resulted in a slight stressing of each locking mechanism 118 which is illustrated by the slight angularity between the forwardly projecting portions 120 and the rearwardly projecting portions 122.

The forwardly projecting portion 120 of each locking mechanism 118 is provided with a contactive surface 124 which is arranged to contactively abut the first or initial ramp surface 126 of the double ramp member 116. Each of the locking mechanisms 118 is coupled to the second connector block member 12 by the post 128. The structure as shown and described may be conveniently molded of plastic dielectric material into a unitary body.

Figure 3:
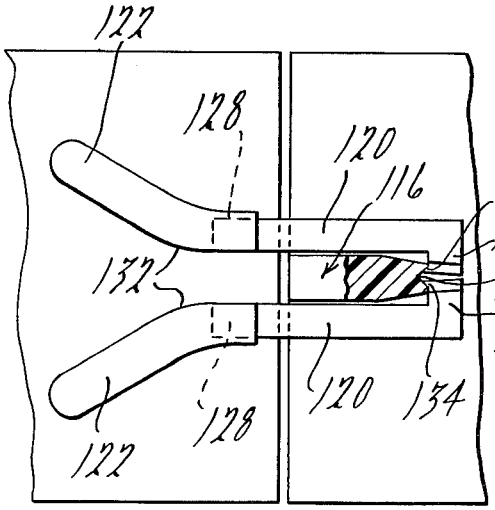
FIG. 3 illustrates in a top elevational view the overcenter locking mechanism of the present invention in assembled relationship.

Referring now to FIG. 3, the overcenter locking mechanism 118 of the present invention is illustrated in a top elevational view in a coupled arrangement wherein the locking mechanism 118 is in locked engagement with the double ramp portion 116. The locking mechanism 118 is illustrated as being comprised of two separate and distinct lever arm members each of which has a forwardly extending portion 120 and a rearwardly extending portion 122. Each forwardly extending portion 120 terminates in a transverse portion or member 130 with the transverse portions 130 arranged to be directed generally toward each other. In the engaged position, the forwardly extending portions 120 are arranged to be generally parallel to each other. The rearwardly extending portions are provided with an angular bend as at 132 and are arranged to be directed generally away from each other. The purpose of this will be explained hereinbelow. Each of the transverse portions 130 is further provided with an inwardly or rearwardly projecting tab of material or corner 134. Double ramp member 116 is illustrated in this view with the rear portion partially broken away and includes a V-shaped notch 136 which is positioned to receive the rearwardly projecting corner 134 so as to lock these corners into position behind the double ramp portion 116. As can clearly be seen from this view, and from consideration of FIG. 2, the forwardly extending portions 120 and the rearwardly extending portions 122 of the lever arm members have substantially the same thickness, or dimension in the direction of the deflection encountered in assembling the connector blocks 10, 12. However, the dimension of the forwardly extending portions 120 of the lever arms in the transverse direction can be seen from FIG. 3 to be smaller than the comparable dimension of the rearwardly extending portions 122 of the lever arm members. This dimensional change facilitates flexure of the forwardly extending portions 120 in the transverse direction to ease disassembly as described hereinbelow.

Figure 4:
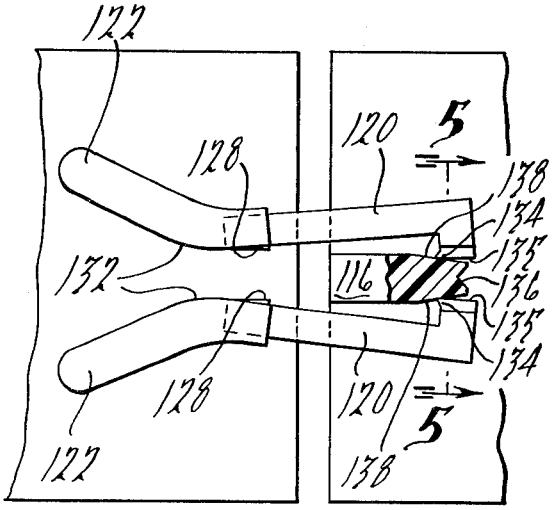
FIG. 4 illustrates in a top elevational view the overcenter locking mechanism of the present invention in a partially intentionally disassembled relation.

Referring now to FIGS. 3 and 4, and particularly to FIG. 4 which shows the relationship of the components of the present invention in an intentionally partially disassembled mode, the operation of the present invention will be described. In assemblying the second electrical connector block member 12 to the first electrical connector block member 10, the two components need only be properly oriented with respect to each other and forcibly brought together in the manner generally described hereinabove with respect to FIG. 1. Thus, second connector block member 12 will be moved in the direction denoted by arrow A in FIG. 2, relative to the first connector block member 10. In those instances where the female connector block member 10 may be fixedly attached to another component, it will only be necessary to forcibly move the male member 12 in the direction of Arrow A in FIG. 2 to assure proper engagement with the female member 10. The application of force tending to insert the male member 12 into the female member 10 will cause the locking mechanisms 118 and particularly the forwardly projecting portions 120 of the lever arm members to be deflected from their normal position due to the interaction of the initial ramp surface 126 and the forward angular portion 124 of the lever arm members 20. The amount of deflection will be a function of the depth to which the male member 12 has penetrated the female member 10 and the height of double ramp member 116. In those instances where insufficient force has been applied, the reaction force produced by the lever arm members 120 due to their deflected position and the cooperating surfaces 124, 126 will be sufficient to forcibly propel the male member 12 away from the female member 10 or leftward, relative to FIG. 2, so as to clearly and visibly indicate, through a clearly disassembled connector block relation, the lack of a circuit connection between the electrical contacts within the male member 12 and the electrical contacts within the female member 10. However, when a sufficiently large application force has been applied to the male member 12, the locking mechanisms 118 and particularly the forwardly extending portions thereof will ride up and over the peak 125 of the double ramp member 116 and the reaction force produced by the forwardly extending portions 120 of the deflected lever arm members added to the insertion force will be sufficient to forcibly propel the male member 12 in the direction of assembly of the connector block members, that is the direction of arrow A of FIG. 2, and the electrical connector will be fully assembled. This action is essentially the same as that accomplished by the prior art device illustrated in FIG. 1. The significant difference in the operation of the present invention resides in the ease of disassembly.

Disassembly is accomplished by forcing the rearwardly extending portions 122 of the locking mechanism 118 together so as to angularly rotate rearwardly extending portions 122 and forwardly extending portions 120 about the pivots 128. This will have the effect of causing the transverse members 130 to move away from each other. The initial movement will cause the projecting corners 134 to forcibly bias the V-shaped notch or groove 136 leftward (relative to FIGS. 3 and 4) for a distance sufficient to permit the projecting corners 134 to freely move apart. When the projecting corners 134 have moved apart a distance at least equal to the distance between the opposed sides of the V-shaped groove or notch 136, the male member 12 may be relatively easily removed from the female member 10. In order to permit the easy disassembly with a minimum of force applied to the rearwardly extending portions 122, the double ramp member 116 is further provided with a pair of camming surfaces 138, described hereinbelow with reference to FIG. 5, positioned on either side of the V-shaped groove or notch 136 and at the rear, or extreme right hand portion (relative to FIGS. 2, 3 and 4) of the double ramp portion 116. Camming surfaces 138 are operative to reduce the amount of deflection required to disengage corners 134 from the V-shaped notch or groove 136. The camming surfaces 138 also cooperate with the inner edges 135 of the transverse portions 130 to apply a separating force directly to the transverse portions 130 to further facilitate their separation upon intentional disassembly. By providing the forwardly extending portions 120 with a reduced transverse dimension compared with their thickness in the assembly deflection direction, the amount of deflection force generated in disassembly is relatively slight.

Figure 5:
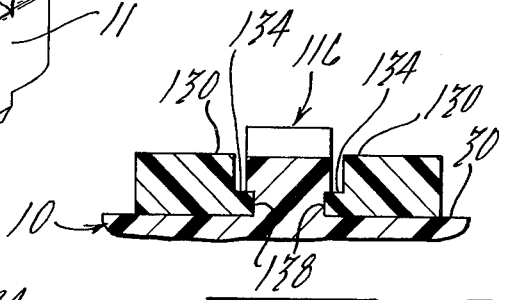
FIG. 5 is an enlarged sectional view taken along section lines 5—5 of FIG. 4 of the double ramp member and the portion of the lever arm members which contactively engage the double ramp member.

Referring now to FIG. 5, an enlarged partial sectional view taken along the line 5—5 of FIG. 4 illustrates the interrelationship between the transverse portions 130 of the forwardly projecting lever arm members 120, the inwardly and rearwardly projecting corners 134 and inner surfaces 135 and camming surfaces 138 of the double ramp member 116. As illustrated in this view, the camming surfaces 138 are provided by undercutting the vertical side walls of the double ramp portion 116 so as to be generally perpendicular to the surface of the connector body 10 and at an angle to the centerline of the double ramp member 116.

It can thus be seen that the present invention readily accomplishes its stated objectives. Improvements are provided to each of the component parts of the overcenter locking or latching apparatus, that is to the double ramp member and to the latching mechanism which cooperates with the double ramp member, to provide structure which maintains reliable overcenter locking capability and which is easily intentionally disassembled. By providing a latching mechanism which is comprised of two separately operable but mutually cooperative members, only a slight relative movement in the transverse direction of the transverse portions of these members is necessary in order to free the latching mechanism for easy disassembly. By further providing the camming surfaces and by tailoring the relative cross sectional dimensions of the forwardly extending portions 120, the amount of force required to be generated by the lever arm portions while at the same time assuring that the lever arm portions 120 are capable of the amount of deflection (by elastic deformation) required to free the connector block members. It can also be seen that this structure is readily integrally molded with the connector block members, does not require the use of additional tools or implements and does not greatly alter the size relationships for the connector block assembly.

We claim:

1. In combination with a pair of matable electrical connector block members, easily releasible overcenter locking means comprising:

first and second locking lever arm members attached to one member of the matable pair, each of said lever arm members having a forwardly extending portion and a rearwardly extending portion, each of the forwardly extending portions terminating in a transverse portion, said transverse portions being arranged to extend toward each other and to be in closely spaced relation to each other;

means forming a deformable pivot connection between each of the first and second locking lever arm members and the one member of the matable pair, each pivot connection being at least slightly deformable about one axis, each of said at least one axis of each pivot connection being arranged to be generally perpendicular to the plane formed by the two forwardly extending lever arm portions; and a double ramp member formed on the other member of the matable pair and having first and second ramp surfaces, said double ramp member being positioned on said other member of the matable pair as to be intermediate said forwardly extending lever arm portions, said transverse portions and said pivot connections when the matable pair of connector block members are in fully assembled relation;

each transverse portion including a cooperative surface for cooperating with the double ramp member first surface to deflect the forwardly extending portions in the direction of said one pivot axis and for cooperating with the double ramp member second surface to apply energy stored in said forwardly extending lever arm portions by their deflection to apply an additive force to urge the matable pair of connector blocks together;

said rearwardly extending lever arm portions operative to forcibly rotate said first and second locking lever arm members about said one pivot axis to cause said transverse portions to be rotated apart whereby the cooperation of the forwardly extending lever arm portions and the second surface of the double ramp member in generating a force to urge the matable pair of connector block members together may be avoided during intentional disassembly.

2. The apparatus of claim 1 wherein each transverse portion includes a rearwardly directed projection arranged to be in close proximity to a similar projection on the other transverse portion and said double ramp member includes a projection receiving notch intermediate its second ramp surface and the surface of the other of the matable pair of connector block members whereby the transverse portions of the forwardly extending lever arm portions will be locked in closely spaced relation by the cooperation of said projections with said notch when the matable pair of connector block members are in fully assembled relation.

3. The apparatus of claim 2 including further a pair of cam surfaces on opposite sides of said double ramp member, said cam surfaces being arranged to be generally perpendicular to the surface of the other member of the matable pair and to be angularly disposed in relation to said second surface of said double ramp member, said cam surfaces cooperative with the transverse portions during intentional disassembly to apply a separation force to the ends of the forwardly extending portions through the transverse portions whereby the transverse portions are forced apart to facilitate disassembly.

4. In combination with an overcenter locking mechanism for a pair of matable electrical connector block members of the type having at least one double ramp member formed on one of the pair of connector block members and means forming a latching mechanism on the other of the pair of connector block members wherein the double ramp member is provided with a first surface for cooperating with the latching mechanism to deflect the latching mechanism in a first direction toward a stressed condition and a second surface for cooperating with the latching mechanism when in the stressed condition to generate a force tending to urge the connector block members to a fully assembled condition, the improvement wherein said latching mechanism comprises:

first and second forwardly extending lever arm portions having transverse portions at the free ends thereof, said transverse portions extending from one of the first and second forwardly extending lever arm portions toward the other of the first and second lever arm portions, the ends of said transverse portions being in normally closely spaced relation;

first and second rotationally deformable means rotationally deformable in opposite directions transverse to the first direction connecting said first and second forwardly extending lever arm portions to the other of the pair of connector block members; and first and second rearwardly extending portions connected to said first and second forwardly extending portions in proximity to said first and second rotationally deformable means operative to apply a rotationally deforming force to said deformable means in said opposite directions for causing said transverse portions to move apart whereby the cooperative action of the transverse portions and the double ramp member second surface may be avoided upon intentional disassembly.

5. The apparatus of claim 4 wherein said transverse portions include rearwardly directed projections arranged at the closely spaced ends of the transverse portions and the double ramp member is provided with a projection receiving notch intermediate the second surface of the double ramp member and the surface of the one connector block member, said projections and double ramp member notch being cooperative to lock the transverse portions in closely spaced relation.

6. The apparatus of claim 5 wherein said double ramp member includes a pair of cam surfaces disposed on opposite sides thereof and arranged to be generally angularly disposed in relation to the double ramp member second surface and the adjacent surface of the one connector block member, said double ramp member projection receiving notch being arranged to be intermediate said cam surfaces.

* * * * *